United States Patent [19]

Bolton et al.

[11] Patent Number: 4,466,873

[45] **Date of Patent: * Aug. 21, 1984**

[54] VACUUM DUAL CONTROL SYSTEM FOR THE FLAT BOX SECTION OF A PAPERMAKING MACHINE

[75] Inventors: Joseph A. Bolton, Queensbury; Jeffrey B. Duncan, Argyle, both of N.Y.

[73] Assignee: Albany International Corp., Menands, N.Y.

[ * ] Notice: The portion of the term of this patent subsequent to Aug. 16, 2000 has been disclaimed.

[21] Appl. No.: 473,737

[22] Filed: Mar. 9, 1983

Related U.S. Application Data

[63] Continuation-in-part of Ser. No. 275,298, Jun. 19, 1981, abandoned.

[51] Int. Cl.[3] ..... D21F 1/52; D21F 11/02

[52] U.S. Cl. ..... 162/198; 162/199; 162/217; 162/252; 162/262; 162/263; 162/274

[58] Field of Search ..... 162/252, 253, 317, 254, 162/263, 198, DIG. 11, 217, 262

[56] References Cited

PUBLICATIONS

Lavigne, "Instrumentation Applications", The Foxboro Co., Miller Freeman Publications, 1979, pp. 208–209.

*Primary Examiner*—Steve Alvo

*Attorney, Agent, or Firm*—Kane, Dalsimer, Kane, Sullivan & Kurucz

[57] ABSTRACT

A vacuum dual control system for the flat box section of a papermaking machine. The system includes a plurality of serially arranged vacuum boxes and a header interconnecting the boxes. A vacuum pump is operatively connected to the boxes in a manner so that vacuum applied to the boxes is a function of the speed of the pump. A first control operates the pump to run at an initial substantially constant high speed for providing vacuum necessary to dewater a web in its initial condition. The web is passed over the boxes so that suction applied therethrough by the pump running at its initial substantially constant high speed dewaters the web until the condition of the web changes sufficiently to cause the vacuum in the last box to increase to a predetermined maximum level. A second control is provided with set point adjustment capabilities to enable selection of a predetermined set point corresponding to the predetermined maximum vacuum level. The second control is connected to the last box and the vacuum pump and includes a sensor to sense the vacuum as determined by the second control sense point and only operable in place of the first control. Operation of the first control is terminated the control is initiated in response to the sensor sensing the vacuum level reaching the maximum level as determined by the second control set point to correspondingly lower the speed of the vacuum pump and maintain the maximum vacuum level.

10 Claims, 2 Drawing Figures

VACUUM DUAL CONTROL SYSTEM FOR THE FLAT BOX SECTION OF A PAPERMAKING MACHINE

This is a continuation-in-part of Ser. No. 275,298 filed June 19, 1981, now abandoned.

BACKGROUND OF THE INVENTION

There are numerous well known dewatering systems in use today in the papermaking industry. A common system is a Fourdrinier paper machine employing a flat box section with a plurality of serially arranged flat boxes interconnected by a header. At least the last box is usually identified as a dry box. It is common practice to interconnect the boxes as a series with vacuum controllers maintaining the desired vacuum conditions. In the interconnected system, a maximum vacuum level is generally required at the header due to the pressure drop across the controller for the last flat box or boxes which normally run at the highest vacuum. The need for the maximum vacuum level at the header produces high energy demands even when the vacuum level is not necessarily required for dewatering purposes in the system. Accordingly, a system which reduces this energy consumption condition in a papermaking machine would be extremely desirable.

There are several basic types of vacuum pumps used for providing the most efficient vacuum system for different types of papermaking machine applications such as the one discussed above. Three basic types of vacuum pumps used in the paper industry are the liquid ring pump, positive displacement pump, and the centrifugal exhauster, some times called a blower. Each type has its advantages and disadvantages with respect to the others and the choice of vacuum pump is based on system parameters. It is clearly desirable to be able to provide for the use of any type of vacuum pump mentioned above in a conventional manner as part of a papermaking machine such as a Fourdrinier paper machine. Furthermore, such use in conjunction with particular parts of the machinery such as the flat box section to provide a vacuum control system which produces significant energy savings so that a more efficient and inexpensive system results therefrom is a distinct improvement.

Cost savings from an energy standpoint have been realized in the design of systems which minimize horsepower requirements for vacuum pumps. These developments are amply disclosed in U.S. Pat. Nos. 4,308,077 and 4,329,201.

Variable speed motors also appear in the general state of the art in controlling vacuum systems. Examples of references of interest in this area are U.S. Pat. Nos. 3,490,689; 3,005,490; 3,935,061; and 3,077,924. Also, German Patent No. 2,849,881 and the Lavigne publication entitled Instrumentation Applications of the Foxboro Company in 1979 pages 208–209 are of interest in this respect. These systems are somewhat limited in that they relate only to a system of continuous adjustment in response to continuously changing vacuum conditions.

None of these systems recognizes the beneficial results that can be obtained by maintaining a constant high pump speed until a predetermined maximum vacuum level is reached and thereafter taking advantage of adjustable controls to actuate a variable speed motor to adjust the pump speed from that point on to monitor the vacuum level and maintaining the predetermined maximum vacuum level. This concept requires the introduction of a dual control system with one of the controls operating to run the variable speed motor and accordingly the pump at a constant speed until a set point is reached corresponding to the maximum vacuum level to initiate the operation of a second control to operate the variable speed motor as a variable speed control for the pump to regulate and constantly adjust the speed of the pump and the vacuum level in the system so that the maximum vacuum level is maintained thereafter.

SUMMARY OF THE INVENTION

With the above background in mind, it is among the primary objectives of the present invention to provide a unique dual control vacuum system for papermaking machinery, in particular the flat box section of a Fourdrinier machine. It is an objective of the present invention to utilize a variable speed drive on any of a number of well known vacuum pumps such as centrifugal exhauster or liquid ring pump to control the vacuum level or air flow demand on the last flat box or dry box of a Fourdrinier paper machine. The system is advantageous in that significant reduction in vacuum pump energy requirement is achieved for dewatering a web at the flat box section of a paper machine. Dramatic results are obtained on machines making multi-grades where vacuum pump air requirements vary to dewater various grades.

It is an objective of the present invention to provide a new vacuum control approach for dewatering a web at the flat box section of a paper machine similar to systems depicted and described in the above referenced patents. The improvement resides in elimination of a vacuum controller on the last dry box or boxes of a serially arrangement of boxes interconnected by a header in the flat box section. The vacuum controller in the last box is replaced by a variable speed drive mechanism for the vacuum pump. Consequently, instead of using a vacuum controller on the last box to control its desired vacuum, the speed of the vacuum pump is adjusted to satisfy its needs.

It is a further objective of the present invention to provide a dual control system with first and second controls, each operable at different times. The first control operates the variable speed drive for the vacuum pump to run the pump at a substantially constant high speed to dewater the web at its initial condition. This substantially constant speed is maintained in effect until the vacuum level reaches a predetermined maximum level. The maximum level is determined by a set point control. When the set point is reached, operation of the first control is terminated and the second control is initiated to operate the variable speed drive mechanism for the vacuum pump and adjust the speed of the pump to maintain the predetermined maximum vacuum level thereafter.

Consequently, instead of using a vacuum controller on the last box to control the desired vacuum, and instead of merely adjusting the speed of a vacuum pump during the life of the web, the vacuum pump is run at an initial high speed for a period of time and thereafter the pump speed is varied to accommodate changing web conditions in order to maintain the desired vacuum. This is accomplished by means of a unique dual control system whereby a first control operates the pump at the high initial speed and a second control independent of the first control operates to provide adjustment of pump speed to correspond to changing web conditions.

Switching between controls is determined by adjusting a control set point to correspond to a predetermined maximum vacuum level.

By removing the need for a vacuum controller, there is a reduction in the maximum vacuum level required at the header because of the elimination of the pressure drop across the controller for the last flat box or boxes, which normally runs at the highest vacuum. A reduction in the vacuum level at the header from 15 inches hg to say 12 inches hg typical vacuum for the last flat box would require 19% less drive horsepower using a centrifugal exhauster and 10% less horsepower using a liquid ring vacuum pump. The energy saving in many cases would be much higher because these figures are based upon a perfectly sized vacuum pump system where the air flow requirements at the flat boxes do not vary. For example, if the air flow requirements at the flat boxes would vary by say 30%, which is not uncommon, then the liquid ring vacuum pump could be slowed down by 30% and still maintain its vacuum level. This would decrease the vacuum pump drive horsepower by approximately 50% versus a constant speed vacuum unit. A 30% reduction in air flow with a variable speed centrifugal exhauster system would save an additional 14% or approximately 33% overall. An exhauster maximum vacuum, unlike a liquid ring or positive displacement vacuum pump, is affected by speed. Therefore, its speed cannot be reduced as much as a liquid ring pump and still maintain a given vacuum level. In both cases, using either a liquid ring pump or a centrifugal exhauster, significant energy savings are achieved.

A modification of the present system contemplates the use of an additional flat box in the dry zone which would be utilized to take any excess vacuum pump air capacity similar to the concept of increasing dwell time for felt dewatering.

In summary, a vacuum dual control system for a flat box section of a papermaking machine is provided. The system includes a plurality of serially arranged vacuum boxes and a header interconnecting the boxes. A vacuum pump is operatively connected to the boxes in a manner so that the vacuum applied to the boxes is a function of the speed of the pump. A first control operates the pump to run at an initial substantially constant high speed for providing vacuum necessary to dewater a web in its initial condition. The web to be dewatered is passed over the boxes so that suction applied therethrough by the pump running at its initial substantially constant high speed dewaters the web until the condition of the web changes sufficiently to cause the vacuum in the last box to increase to a predetermined maximum level. A second control is provided and has set point adjustment means thereon to enable selection of a predetermined set point corresponding to the predetermined maximum vacuum level. The second control is connected to the last box and the vacuum pump and includes sensing means to sense the predetermined maximum vacuum level as determined by the second control predetermined set point and only operable in place of the first control. Operation of the first control is terminated and operation of the second control is initiated in response to the sensing means sensing the vacuum level reaching the maximum vacuum level as determined by the second control set point to correspondingly lower the speed of the vacuum pump and maintain the maximum vacuum level.

With the above objectives among others in mind, reference is made to the attached drawings.

DETAILED DESCRIPTION

Figure 1:
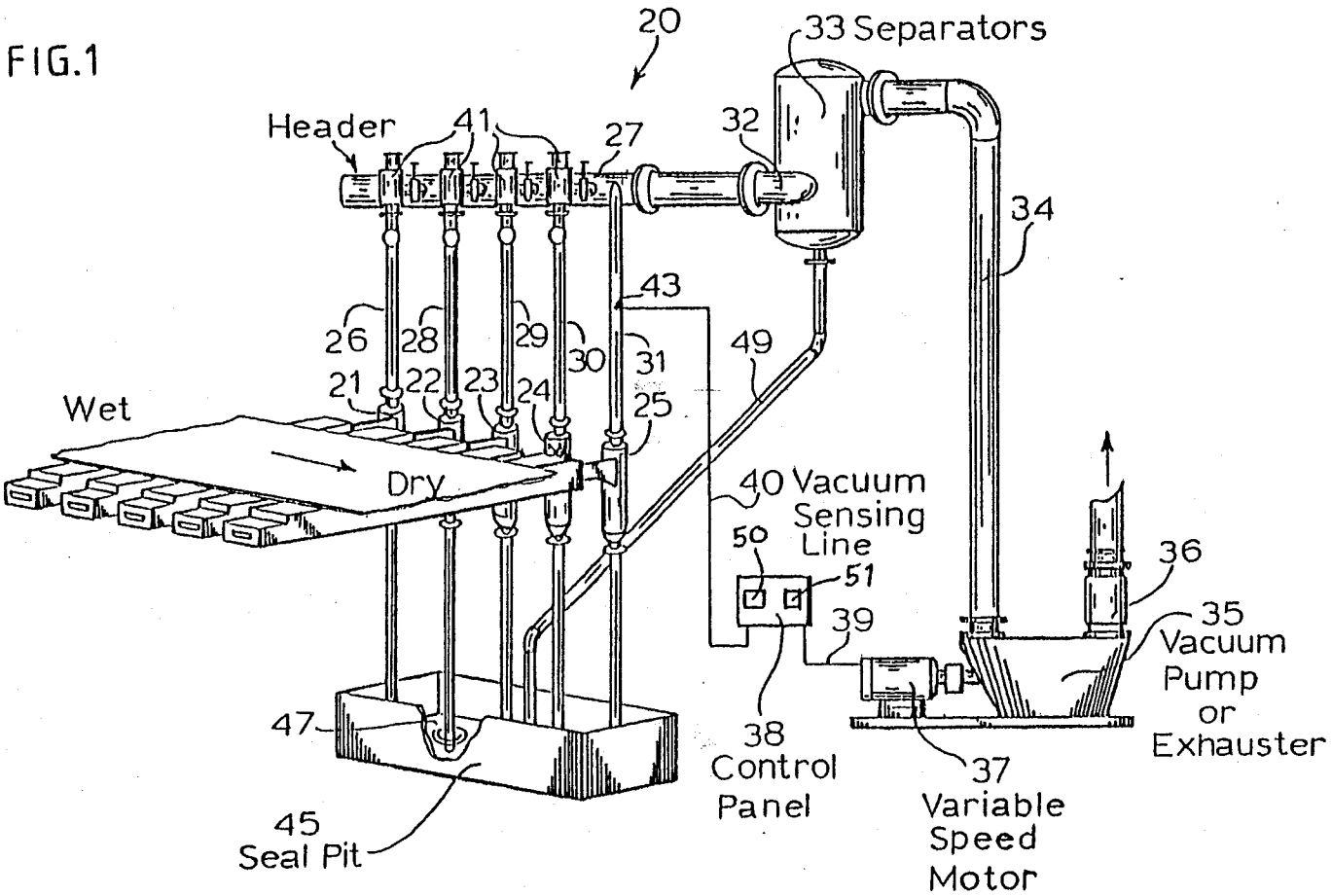
FIG. 1 is a schematic view of the vacuum control system incorporated as part of the flat box section of a papermaking machine.

The flat box section 20 of a papermaking machine such as a Fourdrinier machine is depicted in schematic form in FIG. 1. As shown by the arrow, the web passes across the top of the flat box section 20 from left to right and from the wet end of the machine to the dry end in the dewatering process. As shown, there are five flat boxes, 21, 22, 23, 24, and 25. The last box 25 is a dry box at the end of the section. The system is shown from the front so that the web to be dewatered passes from left to right over boxes 21, 22, 23, 24, and 25 in sequence. Each of the boxes has suitable openings in its upper surface for access to the web for dewatering purposes. The water passes through a conduit 26 from box 21 into a hollow header 27. Header 27 is a hollow conduit extending perpendicular to conduit 26 from box 21. A similar conduit 28 passes from box 22 into header 27. A similar parallel conduit 29 extends between box 23 and header 27. A further conduit 30 extends from box 24 to header 27 and a conduit 31 extends between box 25 and header 27. Conduits 26, 28, 29, 30 and 31 have open bottom ends extending into a seal pit 45. The open end of each conduit is positioned below the water surface 47 in seal pit 45 to maintain the vacuum condition in the system.

The end of header 27 at the dry end of the machine is interconnected with conduit 32. Conduit 32 passes into a separator 33 for conventional separation of the water and air mixture collected in the vacuum system. The separated air passes through conduit 34 to a conventional vacuum pump or centrifugal exhauster 35 which exhausts the air at an outlet 36.

The separated water passes from separator 33 through conduit 49 into seal pit 45. Collected separated water within conduits 26, 28, 29, 30 and 31 also is accumulated in the seal pit 45 through the bottom open end of each such conduit.

A conventional variable speed motor 37 is connected to the vacuum pump 35 to control the speed of the vacuum pump in response to a signal from a control panel. Control panel 38 is interconnected with variable speed motor 37 by means of electrical connections 39 and in turn is connected by an electrical or pneumatic vacuum sensing line 40 to the last flat box 25 in the section 20. A suitable conventional sensing mechanism 43 is in communication with the interior of conduit 31 to sense the vacuum conditions in the conduit 31 and, through connection to the control panel, adjust the variable speed motor and vacuum pump accordingly. Appropriate vacuum controllers 41 are utilized on the boxes other than the last drive box 25.

In operation, control panel 38 includes a dual control system. A first control 50 electrically operates the variable speed motor 37 at a substantially constant initial high speed which in turn operates the vacuum pump 35 at an initial substantially constant high speed. The motor and the pump continue to run at this speed as the web passes over the flat boxes and the condition of the web being dewatered changes a predetermined degree. The control panel 38 also includes a second separately operable control 51 which is electrically connected with sensor 43 by means of electrical conduit 40. The second control 51 is provided with set point adjustment means to provide a predetermined set point corresponding to a predetermined maximum vacuum demand within conduit 31. When the vacuum demand or level reaches this set point as the web condition changes and, accordingly, permeability of the web decreases, electrical switching action terminates operation of the first control 50 and initiates operation of the second control 51 which thereafter adjust the motor speed of motor 37 and accordingly the speed of pump 35 to maintain the maximum vacuum level as the condition of the web continues to change.

Thus, until the set point is reached as sensed by the sensor 43, the first control 50 operates the variable speed motor and the pump at a substantially constant high speed. When the set point is reached and the sensor 43 senses the predetermined maximum vacuum level within conduit 31 in connection with dry box 25, the second control 51 on electrical panel 38 reacts to this vacuum demand and is actuated to adjust the variable speed motor accordingly and thereby adjust the speed of the vacuum pump. As stated, initiation of the second control is accompanied by termination of operation of the first control Accordingly, instead of using a vacuum controller on the last box to control the desired vacuum, a dual control system is provided to operate the speed of the vacuum pump at a constant high level until a set point on the controller has been reached corresponding to a predetermined maximum vacuum level at the last box. From that point on, a second control replaces the first control and the speed of the motor and connected vacuum pump is adjusted to maintain the predetermined maximum vacuum level required in connection with the last box.

It should be noted that this sequence of operation reduces the maximum vacuum level required at the header 27 due to the elimination of the pressure drop across the controller for the last flat box 25, which normally runs at the highest vacuum. Reducing the vacuum level at header 27 requires less drive horsepower for the centrifugal exhauster or, alternatively, for a liquid ring type vacuum pump. The result is an energy savings in use of the system.

Figure 2:
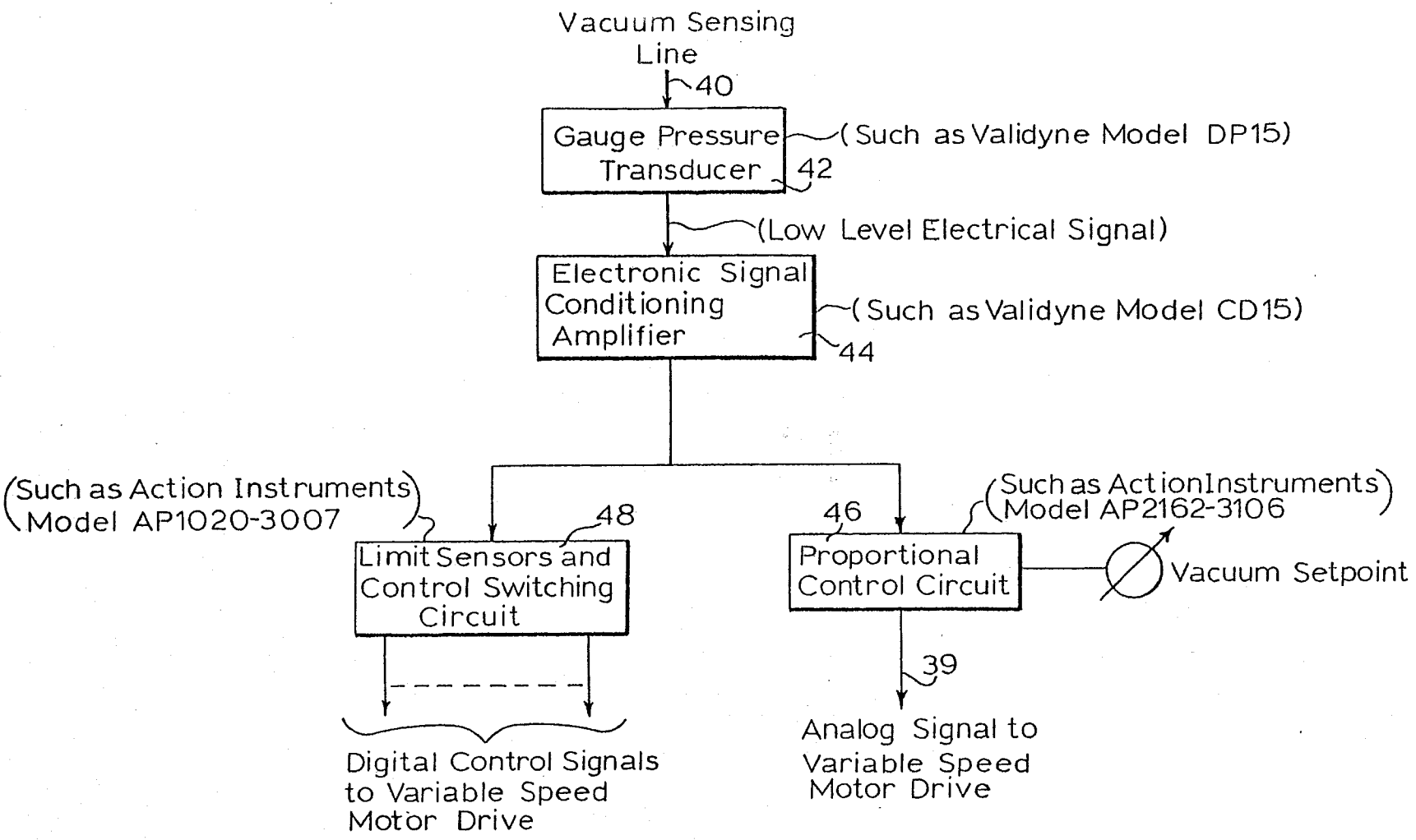
FIG. 2 is a block diagram of the controls of the vacuum control system of the invention.

Electrical panel 38 operates in the following manner as depicted in FIG. 2. Conventional electrical control 50 is normally initially in operation to operate the variable speed motor at a constant high speed which in turn operates the vacuum pump at an initial constant high speed. The vacuum level in the vacuum sensing line 40 is converted to a lower level electrical signal by a common gauge pressure transducer 42. This lower level signal is amplified by a signal condition amplifier 44, which may also have a non-linear gain characteristic, if desired. In this way, the non-linear air flow characteristics of the pump or exhauster may, in effect be linearized. This permits stable control over a wider range of air flow than would be possible without non-linear gain.

The amplified signal is presented to a proportional control circuit 46 of conventional design on electrical control panel 38. The set point adjustment of this control circuit, which operates as the second control 51, permits setting of the vacuum level to be maintained. The output signal from this proportional control circuit 46 is used as the speed control signal through line 39 into the variable speed motor drive.

Until the set point is reached, control circuit 46 is inactive. Interconnected first control means 50 continues to operate the adjustable motor at a constant high speed. When the signal from the sensor 43, converted to an electrical signal, corresponds to the set point, the second control means 50 including control circuit 46 is triggered. Thereafter, the output signal from the proportional control circuit 46 through line 39 continuously adjusts variable speed motor drive 37 as it continuously receives the changing vacuum demand signal from sensor 43.

In addition to controlling pump motor speed in normal operation, the controls must protect the pump and motor from abnormal conditions. Circuitry 48 consisting of limit sensors and digital logic gates provides orderly and safe shutdown in such circumstances. The circuits also control system startup. Digital signals from the circuits are connected directly to control inputs on the variable speed motor drive 37.

Conventional elements are available for all portions of the above described circuitry. For example, acceptable for gauge pressure transducer 42 is a Model DP15 manufactured by Validyne Engineering Corporation of Northridge Calif. 91324 Model CD 15 of the same company functions successfully as the electronic signal conditioning amplifier 44. Proportional control circuit 46 is satisfied, for example, by Model AP 2162-3106 of Action Instruments, Inc. of San Diego, Calif. 92133. An example of acceptable circuitry for the unit sensors and control switching circuit 48 is Model AP 1020–3007 of the same Action Instruments Co., Inc. Suitable conventional electrical switches and circuit elements are employed for the first and second controls 50 and 51 of control panel 38.

Also other conventional equipment can be used as part of the system. For example, a vacuum pump or centrifugal exhauster manufactured by Hoffman Air and Filtration System of Syracuse, N.Y. would be acceptable. Also, the Nash Engineering Company of Norwalk, Conn. supplies equally acceptable vacuum pump equipment. An example of an acceptable variable speed drive motor is one which is known as a variable frequency drive and manufactured by Parametrics of Orange, Conn.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A vacuum dual control system for the flat box section of a papermaking machine comprising:

a plurality of serially arranged vacuum boxes;

a header interconnecting said boxes;

a vacuum pump operatively connected to said boxes in a manner so that the vacuum applied to the boxes is a function of the speed of the pump;

a first control means for operating the pump at an initial substantially constant high speed to produce the vacuum necessary to dewater a web in its initial condition;

means for passing the web to be dewatered over the boxes so that suction applied therethrough by the pump running at its initial substantially constant high speed dewaters the web until the condition of the web changes sufficiently to cause the vacuum in the last box to increase to a predetermined maximum level;

a second control means having set point adjustment means thereon to enable selection of a predetermined set point corresponding to the predetermined maximum vacuum level, said second control means being connected to the last box and the vacuum pump and including sensing means to sense the predetermined maximum vacuum level as determined by the second control means predetermined maximum vacuum level as determined by the second control means predetermined set point and only operable in place of said first control means; and means for terminating operation of said first control means and initiating operation of said second control means in response to the sensing means sensing the vacuum level reaching the maximum vacuum level as determined by the second control means set point to correspondingly lower the speed of the vacuum pump and maintain the maximum vacuum level.

2. The invention in accordance with claim 1 wherein the second control means include a variable speed motor for operating the vacuum pump, only the last box of the flat section being connected with the control means and being the dry box of a Fourdrinier papermaking machine.

3. The invention in accordance with claim 1 wherein the vacuum pump is a liquid ring pump.

4. The invention in accordance with claim 1 wherein the vacuum pump is a centrifugal exhauster.

5. The invention in accordance with claim 1 wherein the second control means includes a gauge pressure transducer connected to the sensing means to convert the sensed vacuum level to a low level electrical signal, a signal conditioning amplifier to amplify the low level electrical signal, a proportional control circuit to receive the amplified electrical signal and having a set point adjustment permitting setting of the maximum vacuum level, a variable speed motor connected to the vacuum pump and to the proportional control circuit so that the output signal from the proportional control circuit operates the variable speed motor to adjust the speed of the vacuum pump.

6. A method of controlling vacuum conditions in the flat box section of a papermaking machine by use of a dual control system comprising:

operatively interconnecting a plurality of serially arranged vacuum boxes with a header and a vacuum pump in a manner so that the vacuum applied to the boxes is a function of the speed of the pump;

operating the vacuum pump by a first controller to run the pump at an initial substantially constant high speed and produce the vacuum necessary to dewater a web in its initial condition;

passing the web to be dewatered over the boxes so that suction applied therethrough by the pump at its initial substantially constant high speed dewaters the web until the condition of the web changes sufficiently to cause the vacuum in the last box to increase to a predetermined maximum level; and lowering the speed of the vacuum pump to maintain the maximum vacuum level by use of the second controller having a set point adjustment to enable selection of a predetermined set point corresponding to the predetermined maximum vacuum level, the second controller being connected to the last box and the vacuum pump and including a sensor to sense the vacuum level as determined by the second controller set point and only operable in place of said first controller by terminating operation of said flat controller and initiating operation of said second controller in response to the sensor sensing the vacuum level reaching the maximum level as determined by the second controller set point.

7. The invention in accordance with claim 6 wherein the second controller includes a variable speed motor for operating the vacuum pump, only the last box of the flat box section being interconnected with the first and second controllers and the last flat box being the dry box of a Fourdrinier papermaking machine.

8. The invention in accordance with claim 6 wherein the vacuum pump is a liquid ring pump.

9. The invention in accordance with claim 6 wherein the vacuum pump is a centrifugal exhauster.

10. The invention in accordance with claim 6 wherein the vacuum level sensed by the sensor of the second controller is converted to a lower level electrical signal by a gauge pressure transducer, the low level electrical signal is amplified by a signal conditioning amplifier, the maximum level is set by a proportional control circuit receiving the amplified electrical signal and having a set point adjustment thereon, and the output signal from the proportional control circuit operating a variable speed drive motor connected to the proportional control circuit and the vacuum pump in order to operate the vacuum pump.

* * * * *

UNITED STATES PATENT AND TRADEMARK OFFICE

CERTIFICATE OF CORRECTION

PATENT NO. : 4,466,873

DATED : August 21, 1984

INVENTOR(S) : Joseph A. Bolton, Jeffrey B. Duncan

It is certified that error appears in the above—identified patent and that said Letters Patent is hereby corrected as shown below:

Column 5, line 29 : after "control"
insert - . -

Column 7, lines 12-14: delete "predetermined maximum vacuum level as determined by the second control means"

Signed and Sealed this

*Twenty-sixth* Day of *February 1985*

[SEAL]

*Attest:*

DONALD J. QUIGG

*Attesting Officer* *Acting Commissioner of Patents and Trademarks*